US007484635B2

(12) United States Patent
Yang et al.

(10) Patent No.: US 7,484,635 B2
(45) Date of Patent: Feb. 3, 2009

(54) PEDAL ASSEMBLY FOR TRASH CAN

(75) Inventors: Frank Yang, Rancho Palos Verdes, CA (US); Joseph Sandor, Santa Ana Heights, CA (US)

(73) Assignee: Simplehuman LLC, Torrance, CA (US)

( * ) Notice: Subject to any disclaimer, the term of this patent is extended or adjusted under 35 U.S.C. 154(b) by 627 days.

(21) Appl. No.: 11/111,048

(22) Filed: Apr. 20, 2005

(65) Prior Publication Data

US 2006/0237458 A1 Oct. 26, 2006

(51) Int. Cl.
*B65D 43/25* (2006.01)
*B65D 1/12* (2006.01)
*B65D 43/26* (2006.01)

(52) U.S. Cl. ..... 220/263; 220/908; 220/908.1

(58) Field of Classification Search ..... 220/263, 220/908, 908.1, 262
See application file for complete search history.

(56) References Cited

U.S. PATENT DOCUMENTS

| | | | | |
|---|---|---|---|---|
| 1,820,555 | A | 8/1931 | Buschman | |
| 1,891,651 | A | 12/1932 | Padelford et al. | |
| 2,759,625 | A | 8/1956 | Ritter | |
| 2,946,474 | A | 7/1960 | Knapp | |
| 3,008,604 | A | 11/1961 | Garner | |
| 3,654,534 | A | 4/1972 | Fischer | |
| 3,891,115 | A | 6/1975 | Ono | |
| 4,081,105 | A | 3/1978 | Dagonnet et al. | |
| 4,200,197 | A | 4/1980 | Meyer et al. | |
| 4,765,548 | A | 8/1988 | Sing | |
| 4,913,308 | A | 4/1990 | Culbertson | |
| 4,918,568 | A | 4/1990 | Stone et al. | |
| 4,972,966 | A | 11/1990 | Craft, Jr. | |
| 5,065,272 | A | 11/1991 | Owen et al. | |
| 5,147,055 | A | 9/1992 | Sampson et al. | |
| 5,170,904 | A | 12/1992 | Neuhaus | |
| 5,174,462 | A | 12/1992 | Hames | |
| 5,226,558 | A | 7/1993 | Whitney et al. | |
| 5,230,525 | A | 7/1993 | Delmerico et al. | |
| 5,249,693 | A | 10/1993 | Gillispie et al. | |
| 5,322,179 | A | 6/1994 | Ting | |
| 5,348,222 | A | 9/1994 | Patey | |
| 5,390,818 | A | 2/1995 | LaBuda | |
| 5,471,708 | A | 12/1995 | Lynch | |
| 5,474,201 | A | 12/1995 | Liu | |
| D377,554 | S | 1/1997 | Adriaansen | |
| 6,010,024 | A * | 1/2000 | Wang | 220/23.87 |
| 6,024,238 | A | 2/2000 | Jaros | |
| D435,951 | S | 1/2001 | Yang et al. | |
| 6,209,744 | B1 | 4/2001 | Gill | |

(Continued)

FOREIGN PATENT DOCUMENTS

| | | |
|---|---|---|
| DE | 19933180 | 1/2001 |

(Continued)

*Primary Examiner*—Anthony D Stashick
*Assistant Examiner*—Shawn M Braden
(74) *Attorney, Agent, or Firm*—Raymond Sun

(57) ABSTRACT

A trash can assembly has a shell, a base secured to the bottom end of the shell, and a pedal assembly coupled to the base. The pedal assembly has a pair of parallel side bars pivotably secured to the base and spaced apart from each other to define an unoccupied space therebetween, and a foot pedal that is secured to the front portion of the side bars.

6 Claims, 3 Drawing Sheets

U.S. PATENT DOCUMENTS 6,250,492 B1 6/2001 Verbeek
6,364,147 B1 4/2002 Meinzinger et al.
6,390,321 B1 5/2002 Wang
6,626,316 B2 9/2003 Yang
6,626,317 B2 9/2003 Pfiefer et al.
6,983,685 B2 * 1/2006 Ko ..... 100/229 A
7,121,421 B2 * 10/2006 Yang et al. ..... 220/263

FOREIGN PATENT DOCUMENTS

JP 6-272888 9/1994
WO WO 92/02430 2/1992

* cited by examiner

PEDAL ASSEMBLY FOR TRASH CAN

BACKGROUND OF THE INVENTION

1. Field of the Invention

The present invention relates to a trash can assembly, and in particular, to a foot pedal for a trash can assembly.

2. Description of the Prior Art

A major concern for both the home and the workplace is containing and holding wastes, refuse, and trash until permanent disposal. Trash cans act as containers for holding trash and other wastes that are produced in any typical home or office. Trash and garbage cans often employ lids and covers to contain the trash and its associated odor, to hide the trash from view, and to prevent the trash from contaminating areas beyond the lid.

Conventional trash cans have been improved over the years to make them more user-friendly, sanitary, and hygienic. For example, many trash cans are now provided with a foot pedal positioned adjacent the base of the trash can so that a user can step on the foot pedal to open the lid of the trash can, thereby freeing up the user's hands to toss trash, or to change the plastic liner or bag that is used to line the trash can.

The conventional foot pedal is usually part of, or connected to, a pedal bar that extends across the base of the trash can, with the rear end of the pedal bar coupled to a bottom end of one or more linking rods. The top end of each linking rod is connected to the lid. Thus, the pedal bar and the linking rod(s) function as a linking system that converts the up-and-down motion of the foot pedal into an up-and-down motion of the lid.

The conventional pedal bar is usually made of a piece of metal. The weight of the conventional pedal bar, as well as providing the pedal bar in a complete piece of metal, increases the cost of manufacturing and shipping for the trash can.

Thus, there remains a need for a trash can assembly that overcomes the drawbacks outlined above.

SUMMARY OF THE DISCLOSURE

It is an object of the present invention to provide a trash can assembly having a pedal bar that is lighter and less expensive than conventional pedal bars.

In order to accomplish the objects of the present invention, there is provided a trash can assembly that has a shell, a base secured to the bottom end of the shell, and a pedal assembly coupled to the base. The pedal assembly has a pair of parallel side bars pivotably secured to the base and spaced apart from each other to define an unoccupied space therebetween, and a foot pedal that is secured to the front portion of the side bars.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

Figure 2:
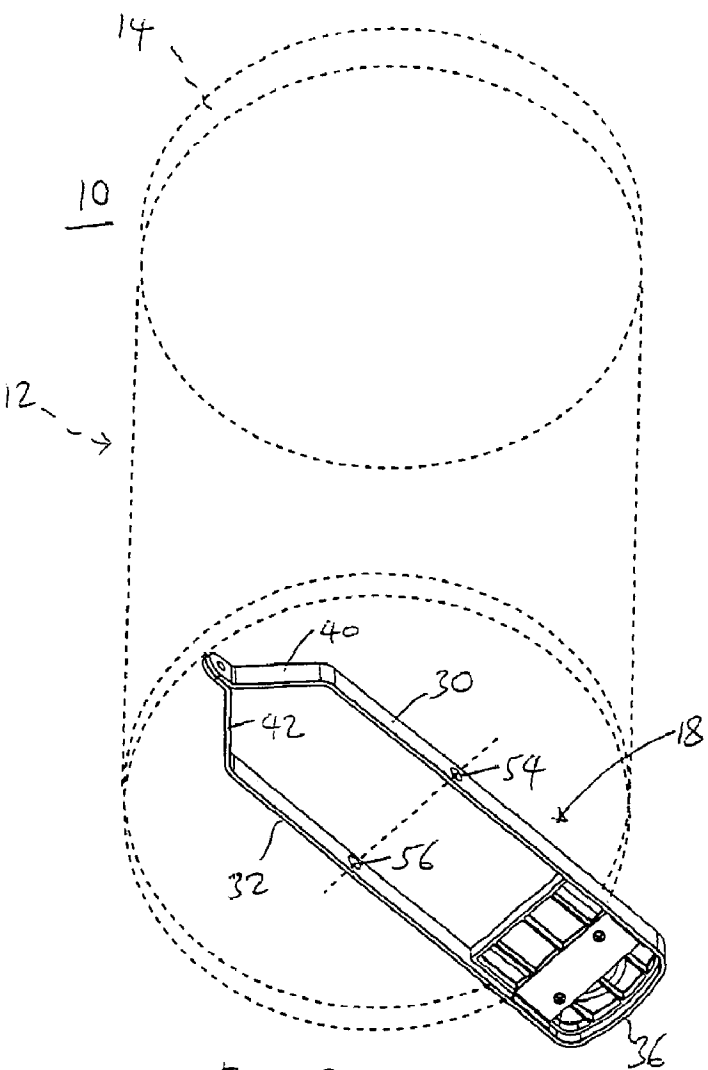
FIG. 2 is an exploded bottom perspective view of the bottom portion of the trash can assembly of FIG. 1 showing only the pedal bar according to one embodiment of the present invention.
Figure 1:
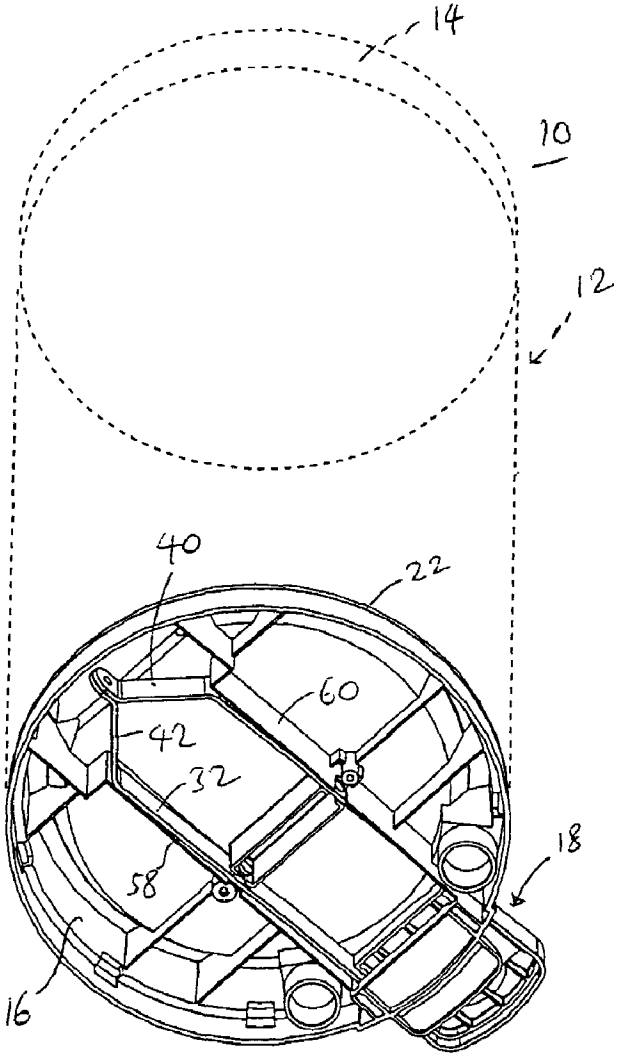
FIG. 1 is an exploded bottom perspectiveve view of the bottom portion of a trash can assembly according to one embodiment of the present invention.
Figure 4:
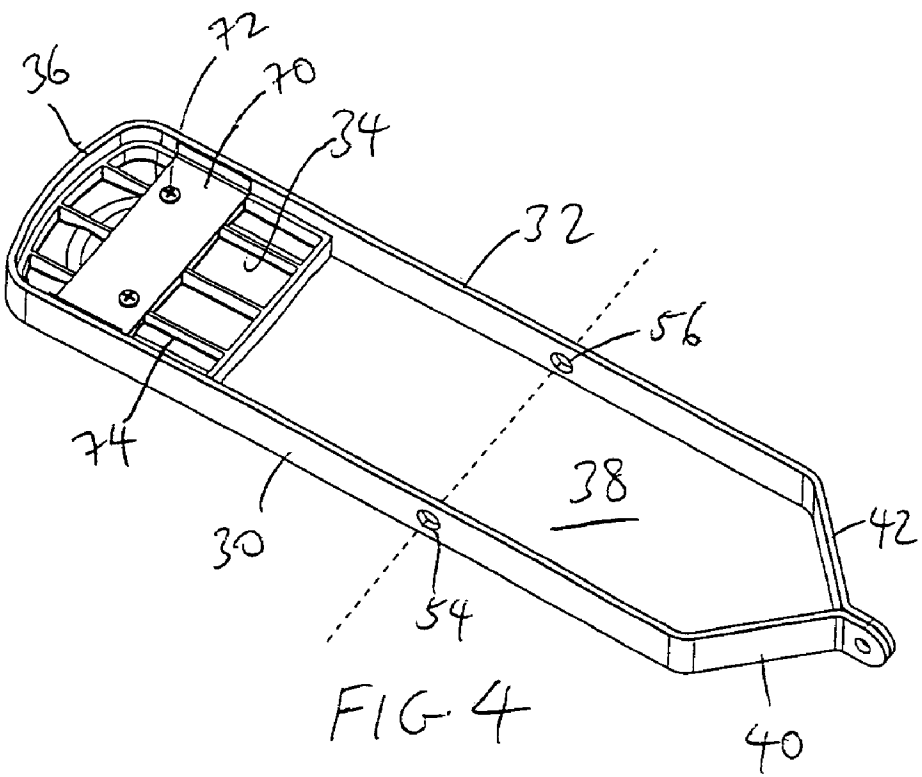
FIG. 4 is a bottom perspective view of the pedal bar of FIG. 2.
Figure 3:
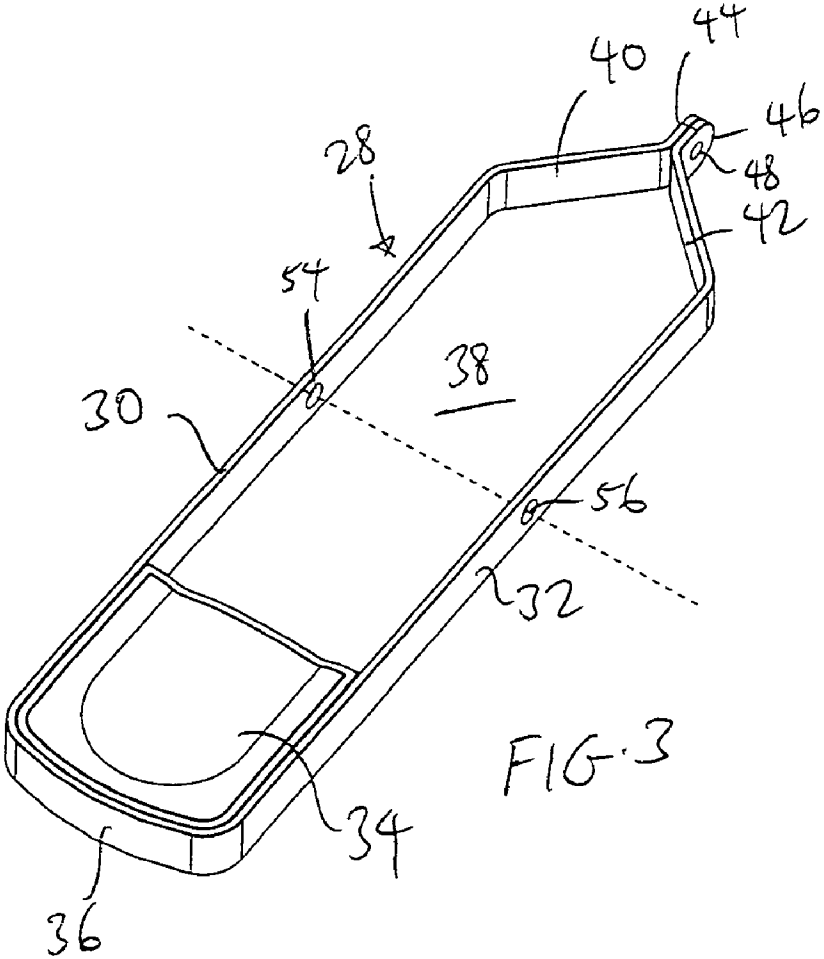
FIG. 3 is a top perspective view of the pedal bar of FIG. 2.
Figure 6:
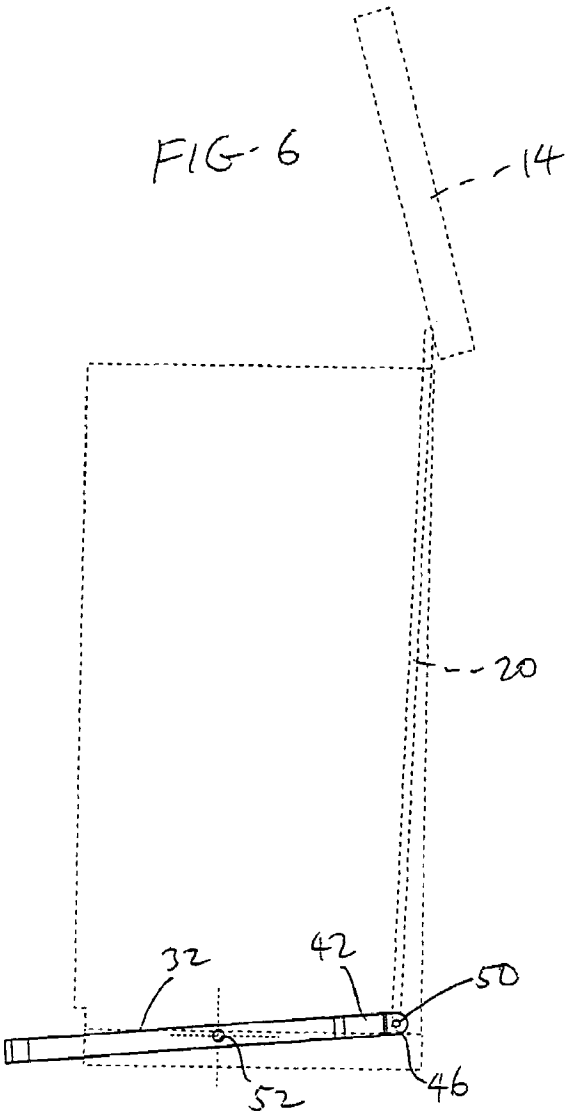
FIG. 6 is a side plan view showing the position of the pedal bar of FIG. 2 when the lid is in the opened position.
Figure 5:
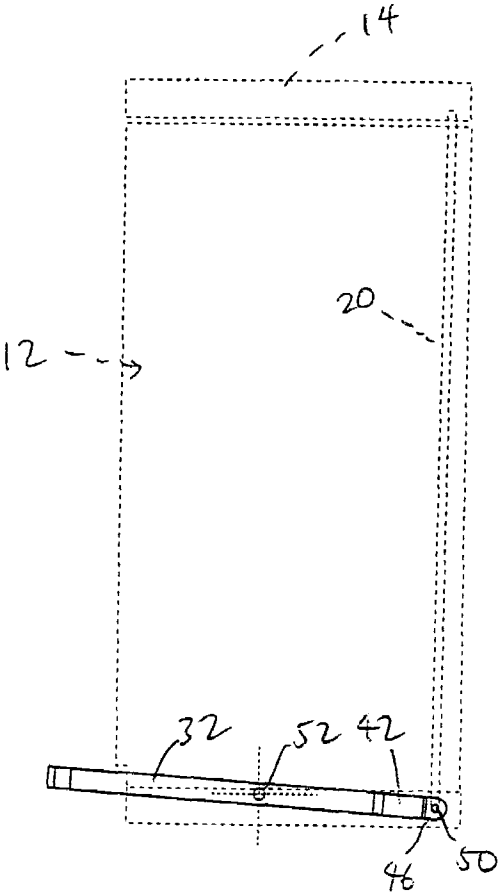
FIG. 5 is a side plan view showing the position of the pedal bar of FIG. 2 when the lid is in the closed position.

FIGS. 1-6 illustrate one embodiment of a pedal assembly 18 for a trash can assembly 10 according to the present invention. Referring first to FIGS. 1-2 and 5-6, the assembly 10 has a shell 12 and can optionally include an internal liner (not shown) that can adapted to be retained inside the shell 12. The shell 12 can be made from either plastic or metal. The liner is essentially a container, and can also be made from either plastic or metal. The shell 12 is an enclosing wall which can have any desired shape, including oval, triangular, rectangular, square or circular (among others).

A lid 14 is hingedly connected to the upper part of the shell 12 using hinged connections that are well-known in the art, and will not be described in greater detail herein. As one non-limiting example, the lid can be hingedly connected to the shell 12 in the manner that is described in U.S. Publication No. US-2002-0079315-A1, published on Jun. 27, 2002 and entitled "Trash Can Assembly With Toe-Kick Recess", whose entire disclosure is incorporated by this reference as though set forth fully herein. The shell 12 and its lid can be made of a solid and stable material, such as a metal. The shell 12 has a base 16, and a pedal assembly 18 is pivotably secured to the base 16.

A linking rod 20 extends from the rear of the pedal assembly 18 and then upwardly along the rear of the shell 12 to the lid 14. The top end of the linking rod 20 is pivotably connected to the rear of the lid 14 in a manner that is well-known in the art. The linking rod 20 operates to translate an up-down pivot motion of the pedal assembly 18 to an up-down pivot motion for the lid 14. The base 16 of the shell 12 defines a generally annular and curved skirt or flange portion 22. In one embodiment of the present invention, the skirt 22 can be formed in one plastic piece. The shell 12 can be attached to the top of the skirt 22 of the base 16 by a groove snap-on, glue, welding, screws, and similar attachment mechanisms.

The pedal assembly 18 has two separate pieces: a border bar 28 and a foot pedal 34. The border bar 28 has a first side bar 30 and a second side bar 32 that are connected by a front bar 36. The side bars 30, 32 and the front bar 36 act as a boundary to define an unoccupied inner space 38, so that the border bar 28 essentially forms an elongated pedal bar that has an empty or hollow interior. The side bars 30, 32 are generally parallel to each other, and extend in a parallel manner rearwardly from the front bar 36. Each side bar 30 and 32 has an angled section 40 and 42, respectively, that angles towards each other at the rear of each side bar 30, 32, and then terminates at a rear tip section 44 and 46, respectively. The tip sections 44 and 46 are parallel to each other, and are positioned side-by-side to each other. Each tip section 44, 46 has an opening 48 that extends therethrough, with the openings 48 aligned with each other to receive a connecting shaft 50 that pivotably couples the bottom end of the linking rod 20 with the tip sections 44, 46. In addition, a pivot shaft 52 is adapted to extend through two aligned openings 54 and 56 located at about the center of the side bars 30 and 32, respectively, with the opposite ends of the pivot shaft 52 secured to retaining members 58 and 60 inside the base 16. Thus, the border bar 28 pivots about a pivot axis defined by the pivot shaft 52 along the aligned openings 54, 56.

In one embodiment, the tip sections 44, 46, the angled sections 40, 42, the side bars 30, 32 and the front bar 36 are formed in one piece of material.

The foot pedal 34 can be secured to the front bar 36 and the front portions of the side bars 30, 32 by any known connection mechanism (e.g., welding, screws and bolts, snap-fits, etc.). For example, a plate 70 can be attached via screws 72 to the foot pedal 34 (see FIG. 4), with the foot pedal 34 separated from the plate 70 by ridges 74.

The border bar 28 can be made of a metal, such as aluminum or steel, which provides rigidity and structural integrity to the pedal assembly 18. The foot pedal 34 can be provided in a separate piece from the border 28, and can be provided in the same material (e.g., a metal such as steel or aluminum) or in a different material (e.g., plastic).

The pedal assembly 18 of the present invention provides a border bar 28 that functions as a pedal bar that is lighter in weight than conventional pedal bars because the border bar 28 defines an empty or hollow interior space 38. This lighter weight decreases the weight of the entire trash can assembly 10, thereby making it less expensive to ship the trash can assembly 10. In addition to the lighter weight, less material (e.g., metal) is needed to make up the pedal bar, thereby making the trash can assembly 10 less expensive to manufacture and assemble. On the other hand, the reduced material and lighter weight do not negatively impact the structural integrity of the pedal assembly 18 because the rigidity of the front portion of the pedal bar 18 is reinforced by the front bar 36 and the foot pedal 34, while the rigidity of the rear portion of the pedal bar 18 is reinforced by the angled sections 40, 42.

Although FIGS. 1-6 illustrate one possible construction and configuration for the pedal assembly 18, it is possible to modify the pedal assembly 18 without departing from the spirit and scope of the present invention. For example, the angled sections 40, 42 and the tip sections 44, 46 can be replaced by providing a rear bar (that is similar to the front bar 36) to connect the rear ends of the side bars 30, 32, with aligned openings (similar to the aligned openings 54, 56) provided at the rear of the side bars 30, 32 to receive the connecting shaft 50.

The above detailed description is for the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices, components, mechanisms and methods are omitted so as to not obscure the description of the present invention with unnecessary detail.

What is claimed is:

1. A trash can assembly, comprising:

a shell having a bottom end;

a base secured to the bottom end;

a pedal assembly coupled to the base, the pedal assembly consisting of:

a pair of parallel side bars pivotably secured to the base and spaced apart from each other, each side bar further including an angled section that extends inwardly from a rear portion thereof to a tip section, with the tip section of each side bar positioned side-by-side with each other;

a front bar that connects the pair of side bars at a front portion thereof; and a foot pedal that is secured to the front bar and the side bars adjacent the front portion, with an empty space defined by the side bars, the angled sections and the foot pedal.

2. The assembly of claim 1, further including a lid at the top of the shell, and a linking rod that has a top end coupled to the lid, and a bottom end pivotably coupled to the tip sections.

3. The assembly of claim 1, wherein each side bar pivots about the base at a location that is at about the center of the side bar.

4. The assembly of claim 1, wherein the side bars are made of metal.

5. The assembly of claim 4, wherein the foot pedal is made of a different material from the side bars.

6. The assembly of claim 1, wherein the side bars and the front bar are made in one piece.

* * * * *